US005752901A

United States Patent [19]

Lee

[11] Patent Number: 5,752,901

[45] Date of Patent: May 19, 1998

[54] EXERCISER

[76] Inventor: Sunny Lee, No. 257-8, Chung-Cheng Rd., Tsao-Tun Chen, Nan-Tao Hsien, Taiwan

[21] Appl. No.: 673,168

[22] Filed: Jun. 26, 1996

[51] Int. Cl.[6] ..... A63B 21/02

[52] U.S. Cl. ..... 482/130; 482/125; 482/140

[58] Field of Search ..... 482/121, 123, 482/130, 140, 125

[56] References Cited

U.S. PATENT DOCUMENTS

| | | | |
|---|---|---|---|
| 3,985,354 | 10/1976 | Schulkin | 482/130 |
| 4,508,341 | 4/1985 | Carrington | 482/130 |
| 4,625,963 | 12/1986 | Lancellotti | 482/130 |
| 4,796,881 | 1/1989 | Watterson | 482/130 |
| 5,256,126 | 10/1993 | Grotstein | 482/130 |
| 5,269,737 | 12/1993 | Sobotka | 482/130 |
| 5,338,277 | 8/1994 | Yang | 482/130 |
| 5,441,473 | 8/1995 | Safani et al. | 482/130 |
| 5,480,369 | 1/1996 | Dudley | 482/130 |

*Primary Examiner*—Lynne A. Reichard
*Attorney, Agent, or Firm*—Fish & Richardson P.C.

[57] ABSTRACT

An exerciser includes a board, a pair of rocking members, and a transverse rod. A connecting tube is fixed to the board. Each end portion of the connecting tube has a hole. Each rocking member has an L-shaped rod, a coil spring member, and a handle which are connected to one another in sequence. Each of the L-shaped rods has a lower end which is inserted into the respective end portion of the connecting tube and which has two positioning holes that are aligned selectively with the hole in the respective one of the end portions of the connecting tube when the L-shaped rod is rotated respectively to first and second positions with respect to the board. Each of the L-shaped rods further has a locking pin which extends through the hole in the respective one of the end portions of the connecting tube and one of the positioning holes in the corresponding one of the L-shaped rods. The upper ends of the handles are connected detachably to the end portions of the transverse rod.

4 Claims, 7 Drawing Sheets

EXERCISER

BACKGROUND OF THE INVENTION

1. Field of the Invention

This invention relates to an exerciser, more particularly to an exerciser which can be operated in different exercising modes.

2. Description of the Related Art

Presently, there are many kinds of exercisers that are available in the market. When purchasing an exerciser, the consumer usually considers the functions offered by the exerciser in addition to its price and quality. However, these exercisers are usually operable in only one exercising mode, thereby resulting in a need for the consumer to buy additional exercisers so as to perform a larger number of exercises.

SUMMARY OF THE INVENTION

Therefore, the object of the present invention is to provide an exerciser which can be operated in more than one exercising mode.

According to the present invention, an exerciser comprises:

a board having a mounting frame fixed to the lower face of the board, and a connecting tube fixed to the mounting frame, each end portion of the connecting tube having a hole formed therein;

a pair of rocking members, each having an L-shaped rod, a coil spring member, and a handle, each of the L-shaped rods having an upper end and a lower end, the lower end being inserted into a respective one of the end portions of the connecting tube and being has two positioning holes that are aligned selectively with the hole in the respective one of the end portions of the connecting tube when the L-shaped rod is rotated respectively to first and second positions with respect to the board, each of the L-shaped rods further having a locking pin which extends through the hole in the respective one of the end portions of the connecting tube and through one of the positioning holes in a corresponding one of the L-shaped rods in order to position the corresponding one of the L-shaped rods selectively and removably in the first and second positions, each of the coil spring members having an upper end and a lower end, the lower end being connected to the upper end of the respective one the L-shaped rods, each of the handles having an upper end and a lower end which is connected to the upper end of a respective one the coil spring members, the upper end of each of the handles having a threaded hole formed longitudinally therein; and a transverse rod, each of the end portions of the transverse rod having a through hole formed transversely therein, a screw fastener which extends through the through hole and which engages the threaded hole in a respective one of the handles in order to secure the transverse rod to the upper ends of the handles.

In a preferred embodiment, each of the handles has a foamed rubber sleeved therearound. The transverse rod has a foamed rubber sleeved around the intermediate portion of the transverse rod.

BRIEF DESCRIPTION OF THE DRAWINGS

Other features and advantages of this invention will become apparent in the following detailed description of a preferred embodiment of this invention with reference to the accompanying drawings, in which.

DETAILED DESCRIPTION OF THE PREFERRED EMBODIMENT

Figure 1:
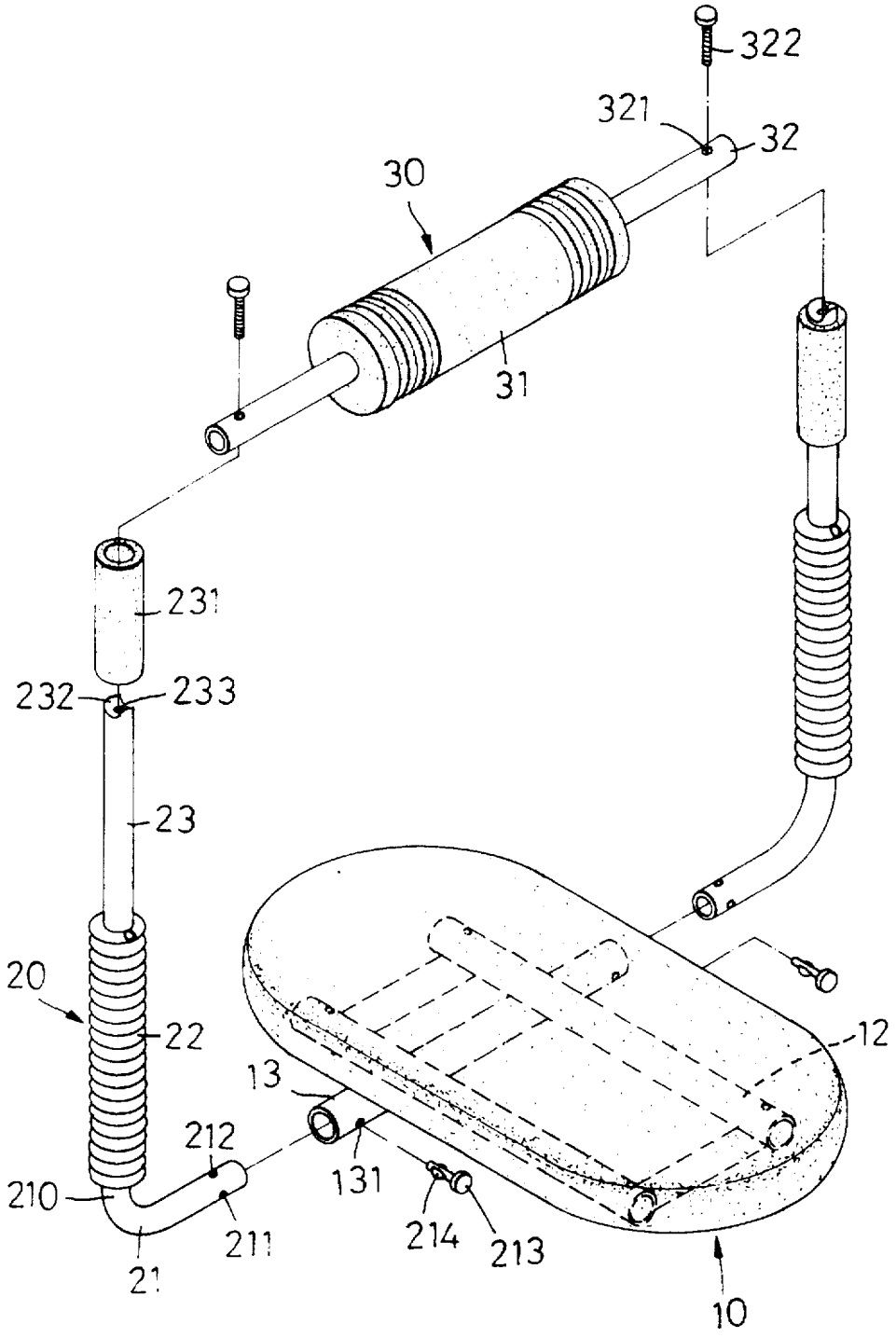
FIG. 1 is an exploded view of a preferred embodiment of an exerciser according to the present invention.
Figure 2:
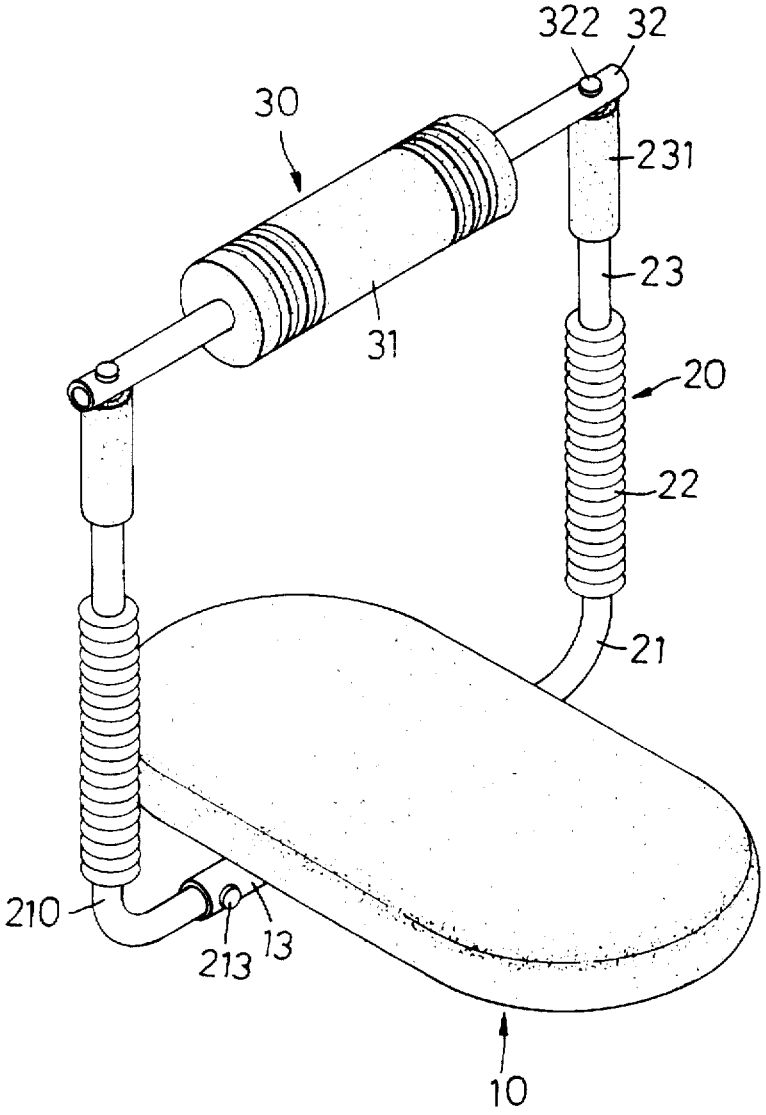
FIG. 2 is a perspective view of the preferred embodiment of the exerciser according to the present invention.

Referring to FIGS. 1 and 2, the preferred embodiment of an exerciser according to the present invention is shown to comprise a board 10, a pair of rocking members 20, and a transverse rod 30.

The board 10 is made of an elastic material and has a mounting frame 12 fixed to the lower face of the board 10. The mounting frame 12 is formed from interconnected metal tubes. A connecting tube 13 is fixed to the mounting frame 12 and has two end portions extending beyond the board 10. Each end portion of the connecting tube 13 has a hole 131 formed therein.

Figure 3:
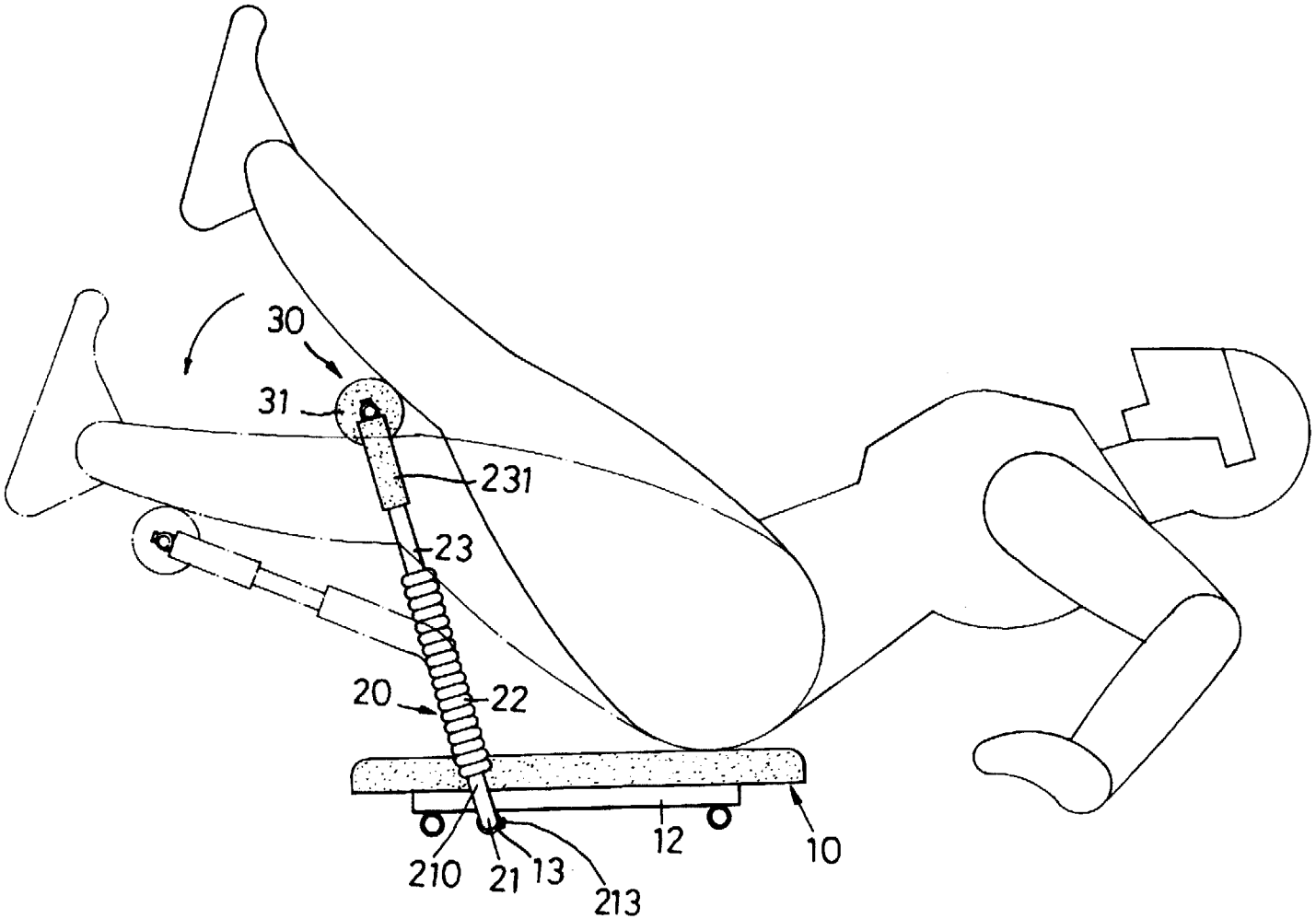
FIG. 3 is a schematic view illustrating the exerciser which is operable in a first exercising mode according to the present invention.
Figure 4:
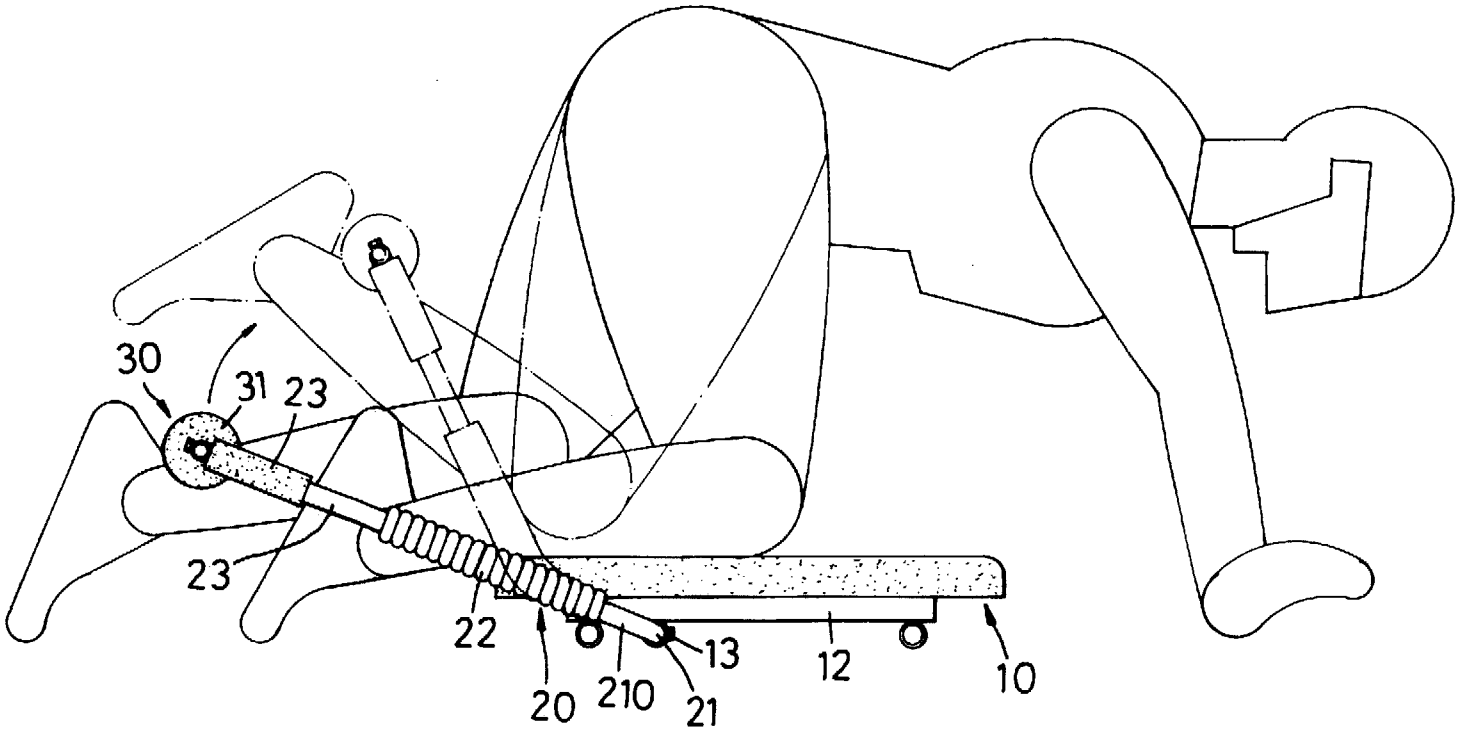
FIG. 4 is a schematic view illustrating the exerciser which is operable in a second exercising mode according to the present invention.

Each of the rocking members 20 has an L-shaped rod 21, a coil spring member 22, and a handle 23. Each of the L-shaped rods 21 has an upper end which is connected to a lower end of a respective one of the coil spring members 22 and a lower end which is inserted into a respective one of the end portions of the connecting tube 13. Each of the lower ends of the L-shaped rods 21 has two positioning holes 211, 212. The positioning holes 211, 212 can be aligned selectively with the hole 131 in the respective one of the end portions of the connecting tube 13 when the L-shaped rod 21 is rotated correspondingly to first and second positions with respect to the board 10, as shown in FIGS. 3 and 4, respectively. As shown, the inclination between the upright portions 210 of the L-shaped rods 21 of the first position and the board 10 is greater than that between the upright portions 210 of the L-shaped rods 21 of the second position and the board 10. Each of the L-shaped rods 21 further has a locking pin 213 which extends through the hole 131 in the respective one of the end portions of the connecting tube 13 and one of the positioning holes 211, 212 in a corresponding one of the L-shaped rods 21 in order to position the corresponding one of the L-shaped rods 21 selectively in the first and second positions. One end of each of the locking pins 213 is provided with opposed, spring-biased balls 214 which retain removably the locking pin 213 to the L-shaped rod 21 and the connecting tube 13, as is known in the art. Thus, the L-shaped rods 21 and the connecting tube 13 are connected removably to one another. The upper end of each of the coil spring members 22 is connected to a respective one of the lower ends of the handles 23. The upper end of each of the handles 23 has a threaded hole 233 formed longitudinally therein and has an arcuate notch 232 so that each of the end portions 32 of the transverse rod 30 can rest matingly on the upper end of the respective one of the handles 23. A foamed rubber 31 is preferably sleeved around the intermediate portion of the transverse rod 30. In addition, each of the handles 23 has a foamed rubber 231 sleeved therearound.

Each of the end portions 32 of the transverse rod 30 has a through hole 321 formed transversely therein, a screw fastener 322 which extends through the through hole 321 and which engages the threaded hole 233 of the respective one of the handles 23 in order to secure the transverse rod 30 to the upper ends of the handles 23.

The operations and the effects of the preferred embodiment of the exerciser according to the present invention are described as follows.

Referring to FIG. 3, the exerciser is schematically shown to be used to exercise the user's thighs. In this case, the L-shaped rods 21 and the rocking members 20 are disposed in the first position where each of the locking pins 213 is inserted into the respective one of the holes 131 in the connecting tube 13 and the respective one of the positioning holes 211. The user sits on the board 10 with his/her body leaning backward and being supported by his/her hands. The user puts his/her calves on the foamed rubber 31 of the transverse rod 30 and pushes the transverse rod 30 downwardly by means of his/her thighs in order to bend the coiled spring members 22 of the rocking members 20 downwardly against the spring force of the coiled spring members 22. The user's legs may be pushed upwardly to their original positions by means of the restoring force when he/she relaxes the muscles of his/her thighs. Therefore, the user can exercise his/her thighs by repeating the aforementioned actions.

Referring to FIG. 4, the exerciser is schematically shown to be used to exercise the user's calves. In this case, the L-shaped rods 21 are positioned in the second position where each of the locking pins 213 is inserted into the respective one of the holes 131 in the connecting tube 13 and the respective one of the positioning holes 212. As shown, the user kneels on the board 10 with one of his/her ankles abutting against the lower face of the foamed rubber 31 of the transverse rod 30. The user may push the transverse rod 30 upwardly by rotating his/her calf toward the thigh against the spring force of the coiled spring members 22 and may then move his/her calf away from the thigh in order to return the coiled spring members 22 to their original positions. By repeating the actions of the calves, the user can exercise the muscles of his/her calves.

Figure 5:
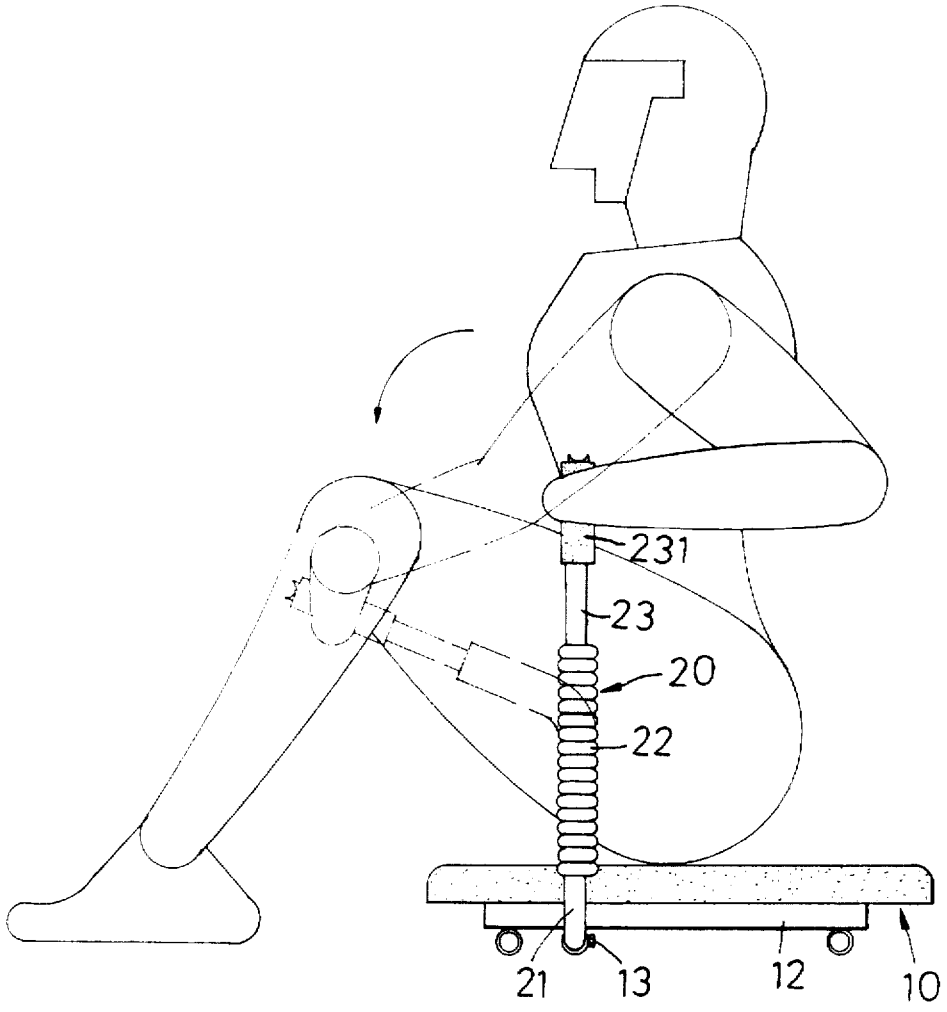
FIG. 5 is a schematic view illustrating the exerciser which is operable in a third exercising mode according to the present invention.

Referring to FIG. 5, the exerciser is schematically shown to be used to exercise the muscles of the user's arms. In this case, the L-shaped rods 21 are positioned in the first position. The user sits on the board 10 and grasps the foamed rubber 231 of the handles 23. The user may push the handles 23 forwardly and downwardly and release the handles 23 to their original upright positions in order to exercise his/her arms. Alternatively, the handles 23 of the rocking members 20 may be pushed alternatively by the user. However, in this case, the transverse rod 30 must be removed from the handles 23 in order to permit the handles 23 to be moved individually.

Figure 6:
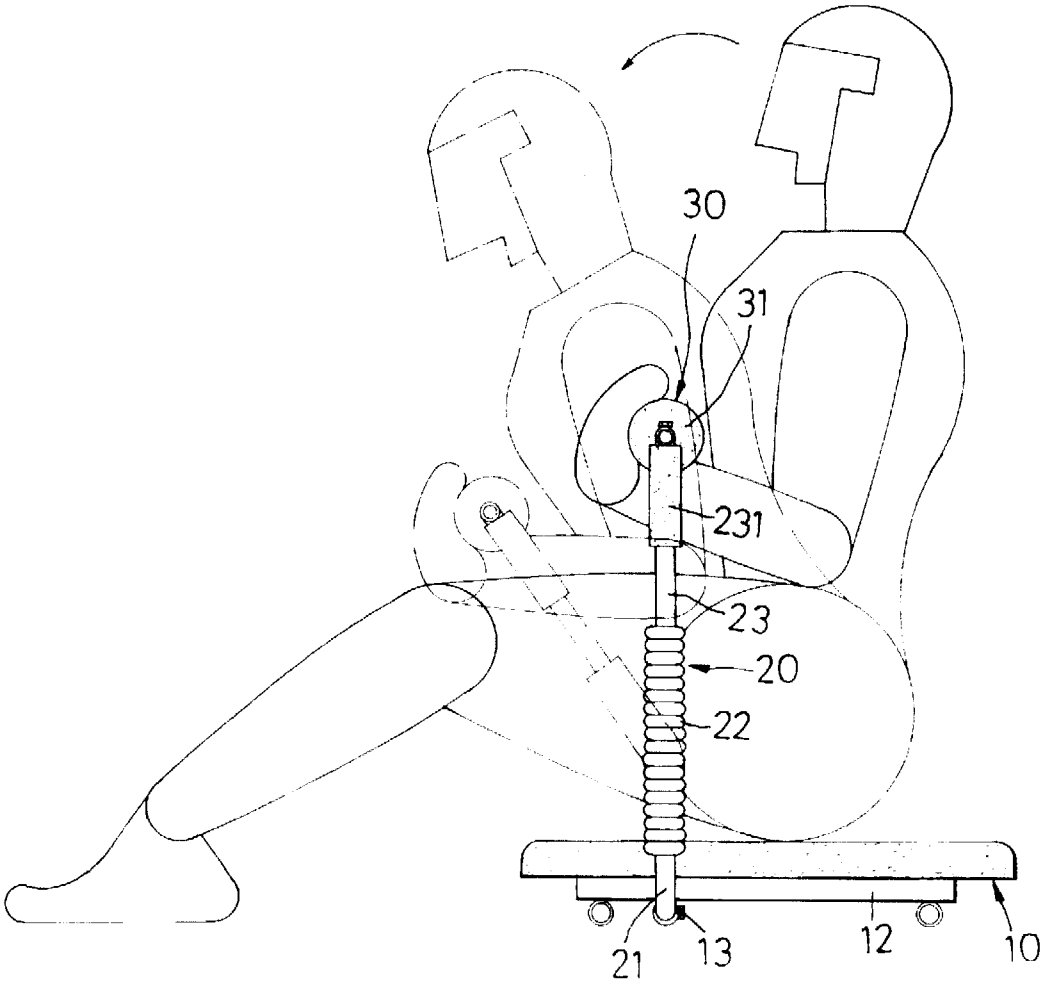
FIG. 6 is a schematic view illustrating the exerciser which is operable in a fourth exercising mode according to the present invention.

Referring to FIG. 6, the user may sit on the board 10 and grasp the foamed rubber 31 of the transverse rod 30 with his/her chest abutting against the foamed rubber 31. The user may bend the upper part of his/her body forwardly and downwardly in order to exercise his/her abdomen and waist.

Figure 7:
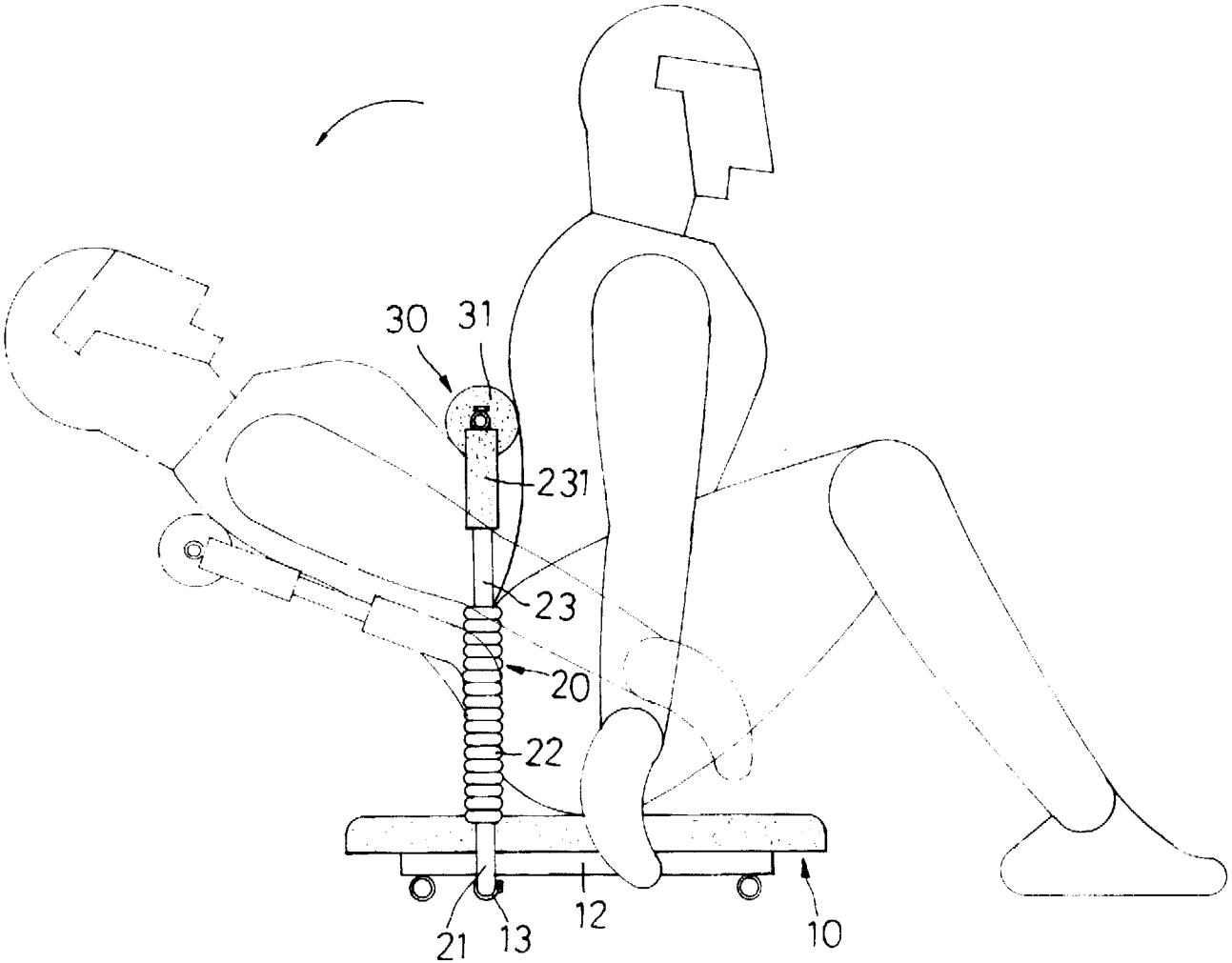
FIG. 7 is a schematic view illustrating the exerciser which is operable in a fifth exercising mode according to the present invention.

Referring to FIG. 7, the user sits on the board 10 and permits his/her back to abut against the foamed rubber 31 of the transverse rod 30. The user may push the rocking members 20 forwardly and downwardly by means of his/her back in order to exercise the muscles of his/her back.

From the foregoing, it can be seen that the exerciser of the present invention can be used to perform various exercises. The object of the present invention is thus met. In addition, the exerciser of the present invention has a simple structure.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangement.

I claim:

1. An exerciser comprising:

a board having a lower face, a mounting frame fixed to said lower face, and a connecting tube fixed to said mounting frame, said connecting tube having two end portions, each of said end portions of said connecting tube having a hole formed therein;

a pair of rocking members, each having an L-shaped rod, a coil spring member, and a handle, each of said L-shaped rods having an upper end and a lower end which is inserted into a respective one of said end portions of said connecting tube and which has two positioning holes that are aligned selectively with said hole in the respective one of said end portions of said connecting tube when said L-shaped rod is rotated respectively to first and second positions with respect to said board, each of said L-shaped rods further having a locking pin which extends through said hole in the respective one of said end portions of said connecting tube and one of said positioning holes in a corresponding one of said L-shaped rods in order to position the corresponding one of said L-shaped rods removably in said first and second positions, each of said coil spring members having an upper end and a lower end which is connected to said upper end of a respective one said L-shaped rods, each of said handles having an upper end and a lower end which is connected to said upper end of a respective one said coil spring members, said upper end of each of said handles having a threaded hole formed longitudinally therein; and a transverse rod having two end portions, each of said end portions of said transverse rod having a through hole formed transversely therein, and a screw fastener which extends through said through hole and which engages said threaded hole in a respective one of said handles in order to secure said transverse rod to said upper ends of said handles.

2. An exerciser as claimed in claim 1, wherein each of said handles has a foamed rubber sleeved therearound.

3. An exerciser as claimed in claim 1, wherein said transverse rod has an intermediate portion and a foamed rubber sleeved around said intermediate portion of said transverse rod.

4. An exerciser as claimed in claim 1, wherein said upper end of each of said handles has an arcuate notch so that each of said end portions of transverse rod can rest matingly on said upper end of the respective one of said handles.

* * * * *